US007588123B2

(12) United States Patent
Woller et al.

(10) Patent No.: US 7,588,123 B2
(45) Date of Patent: Sep. 15, 2009

(54) FOOTHOLD FOR CLIMBING TREE STANDS

(75) Inventors: Ronald R. Woller, Decatur, AL (US); Keith Wilson, Hartselle, AL (US); Scott Echols, Eva, AL (US)

(73) Assignee: Summit Treestands, LLC, Decatur, AL (US)

( * ) Notice: Subject to any disclaimer, the term of this patent is extended or adjusted under 35 U.S.C. 154(b) by 634 days.

(21) Appl. No.: 10/776,845

(22) Filed: Feb. 11, 2004

(65) Prior Publication Data

US 2005/0173193 A1 Aug. 11, 2005

(51) Int. Cl.
*A63B 27/00* (2006.01)

(52) U.S. Cl. ..... 182/136; 182/133; 182/134; 182/135; 182/187; 182/221

(58) Field of Classification Search ..... 182/187, 182/135, 136, 188, 133, 134, 116, 20, 90, 182/91, 92, 221; 54/47, 49; 248/200, 205.1, 248/226.11, 231.71, 304, 689
See application file for complete search history.

(56) References Cited

U.S. PATENT DOCUMENTS

| | | | | | |
|---|---|---|---|---|---|
| 623,517 | A | * | 4/1899 | Carpenter | 248/246 |
| 810,199 | A | * | 1/1906 | Erret | 182/90 |
| 810,254 | A | * | 1/1906 | Borneman | 182/134 |
| 817,969 | A | * | 4/1906 | Galbraith | 248/289.11 |
| 939,318 | A | * | 11/1909 | Redman | 248/304 |
| 1,328,251 | A | * | 1/1920 | Poetz | 182/134 |
| 2,057,013 | A | * | 10/1936 | Curtis | 482/76 |
| 3,078,951 | A | * | 2/1963 | Schneebeli et al. | 182/134 |
| 3,200,904 | A | * | 8/1965 | Weeks | 182/134 |
| 3,460,649 | A | * | 8/1969 | Baker et al. | 182/187 |
| 3,955,645 | A | * | 5/1976 | Dye | 182/135 |
| 3,960,240 | A | * | 6/1976 | Cotton | 182/20 |
| 3,968,858 | A | * | 7/1976 | Vollan et al. | 182/135 |
| 4,130,180 | A | * | 12/1978 | Ferguson et al. | 182/187 |
| 4,137,995 | A | * | 2/1979 | Fonte | 182/135 |
| 4,230,203 | A | * | 10/1980 | Sweat et al. | 182/134 |
| 4,230,296 | A | * | 10/1980 | Staley et al. | 248/309.1 |
| 4,276,958 | A | * | 7/1981 | Skaalen | 182/135 |
| 4,369,858 | A | * | 1/1983 | Babb | 182/134 |
| D270,951 | S | * | 10/1983 | Cryar | D25/62 |
| 4,417,645 | A | * | 11/1983 | Untz | 182/135 |
| 4,512,440 | A | * | 4/1985 | Bixby | 182/146 |

(Continued)

FOREIGN PATENT DOCUMENTS

FR 2627175 A1 * 8/1989

(Continued)

*Primary Examiner*—Katherine W Mitchell
*Assistant Examiner*—Colleen M Quinn
(74) *Attorney, Agent, or Firm*—Gardner Groff Greenwald & Villenueva, P.C.

(57) ABSTRACT

A climbing tree stand includes a platform, a pair of support arms attached to the platform, and a pair of stirrup-like devices attached to the platform or the support arms and extending generally over the platform. The pair of stirrup-like devices are substantially rigid, and each comprises a molded plastic body. In one embodiment, the substantially rigid stirrup-like devices are attached to the support arms of the climbing tree stand and generally are curved downwardly towards the platform.

6 Claims, 5 Drawing Sheets

U.S. PATENT DOCUMENTS

| | | | | | |
|---|---|---|---|---|---|
| 4,549,633 | A | * | 10/1985 | Merritt | 182/135 |
| 4,553,634 | A | * | 11/1985 | Roberts et al. | 182/134 |
| 4,587,798 | A | * | 5/1986 | Taylor | 54/49 |
| 4,593,789 | A | * | 6/1986 | Treants | 182/142 |
| 4,753,447 | A | * | 6/1988 | Hall | 280/163 |
| 4,802,552 | A | * | 2/1989 | Williams | 182/187 |
| 4,953,662 | A | * | 9/1990 | Porter | 182/135 |
| 4,987,972 | A | * | 1/1991 | Helms | 182/187 |
| 5,052,516 | A | * | 10/1991 | Jamieson | 182/135 |
| 5,069,310 | A | * | 12/1991 | Williams et al. | 182/187 |
| 5,103,935 | A | * | 4/1992 | Amacker | 182/187 |
| 5,156,236 | A | * | 10/1992 | Gardner et al. | 182/187 |
| 5,265,780 | A | * | 11/1993 | Matthews et al. | 224/155 |
| D354,143 | S | * | 1/1995 | Floyd, Jr. | D25/62 |
| 5,417,306 | A | * | 5/1995 | Robl | 182/134 |
| 5,497,849 | A | * | 3/1996 | Duffy | 182/136 |
| 5,588,499 | A | * | 12/1996 | Carriere | 182/135 |
| 5,620,059 | A | * | 4/1997 | Crispeno | 182/127 |
| 5,642,789 | A | * | 7/1997 | Maxwell | 182/135 |
| 5,842,540 | A | * | 12/1998 | Mancini, Jr. | 182/136 |
| 5,971,104 | A | * | 10/1999 | Woller | 182/136 |
| 5,975,242 | A | | 11/1999 | Woller et al. | |
| 6,282,872 | B1 | * | 9/2001 | Schulte | 54/49 |
| 6,568,505 | B1 | * | 5/2003 | D'Acquisto | 182/187 |
| D494,117 | S | * | 8/2004 | Ruffin | D12/203 |
| 6,988,588 | B2 | * | 1/2006 | Prejean | 182/136 |
| 7,156,206 | B2 | * | 1/2007 | Prejean | 182/136 |
| 7,165,750 | B2 | * | 1/2007 | McCuskey et al. | 248/214 |
| 7,390,003 | B1 | * | 6/2008 | Sylvia | 280/166 |
| 2006/0272898 | A1 | * | 12/2006 | Hovey et al. | 182/135 |

FOREIGN PATENT DOCUMENTS

| | | | | |
|---|---|---|---|---|
| FR | 2686023 | A1 | * | 7/1993 |

* cited by examiner

FOOTHOLD FOR CLIMBING TREE STANDS

FIELD OF THE INVENTION

The present invention relates generally to climbing tree stands and in particular relates to a foothold or stirrup-like device for use with such tree stands.

BACKGROUND OF THE INVENTION

For some years now, climbing tree stands have incorporated some form of flexible webbing attached to the outboard edges and the centerline of the standing platform, thus forming two loops under which the user would position his/her feet. The use of straps or webbing has become the dominant method of securing one's feet to climbing tree stand platforms. Originally, the loop size was fixed and required an elastic cord to be positioned behind the ankles to assure that the straps would not slip off the feet of the user. Later, an adjustable webbing system was designed to provide more versatility by accommodating different shoe sizes. The major problem with webbing-based systems is the requirement that the user be physically able to bend over and lift the strap to insert one's feet. Considering that this is being accomplished at an elevated position prior to descending from a hunt, there are certain obvious inherent risks in this task that could result in a fall.

One device attempted to overcome these shortcomings by utilizing a straight bar or tube that spanned from one side frame to the opposite side frame. However, this device does not allow any lateral pressure to be applied to aid in control of the tree stand platform.

SUMMARY OF THE INVENTION

Briefly described, in an illustrative form the present invention comprises a climbing tree stand assembly including a platform and a pair of support arms attached to the platform. The climbing tree stand assembly also includes a pair of stirrup-like devices attached to the platform or the support arms and extending generally over the platform. Preferably, the stirrup-like devices each comprise a curved elongate body portion and a clamping portion for attaching to either the platform or the support arms. In one form of the invention, the clamping portions are attached to the support arms. Preferably, the stirrup-like devices are substantially rigid. In one form, the stirrup-like devices can be molded of plastic.

Defined another way, the present invention can comprise a substantially rigid foot engaging member for use with a climbing tree stand of the type including a platform and a support member attached to the platform. Preferably, the foot engaging member includes a first portion for attachment to the climbing tree stand and another portion having a curved elongate body and extending away from the first portion. The first portion can include a clamping or mounting part for attachment to the tree stand. Preferably, the first portion is adjustably mounted on the tree stand so that different sized feet/shoes (or boots) can be accommodated therein. Preferably, the foot engaging member and the tree stand cooperate to form a stirrup-like structure into which the user can place a foot or shoe or boot. In one form, the foot engaging member is molded from plastic and is arcuate. Other materials can be employed, as well as other shapes.

Generally speaking, the present invention forms somewhat of a "stirrup" that the user can slide his or her foot under and apply both lateral control and upward force to securely manipulate the climbing tree stand platform and perform the necessary actions required to ascend and descend the tree. Optionally, the device is adjustable for different shoe sizes by simply sliding the stirrup up or down the side frame. The downward extension of the stirrup allows the user to apply lateral force against the stirrup, further increasing the control of the tree stand platform as it is manipulated up and down the tree. In summary, this invention is a "hands-free" device that is a significant improvement over the conventional webbing design, primarily in the important categories of speed, ease-of-use and safety.

BRIEF DESCRIPTION OF THE DRAWING FIGURES

DETAILED DESCRIPTION OF THE PREFERRED EMBODIMENTS

Figure 1:
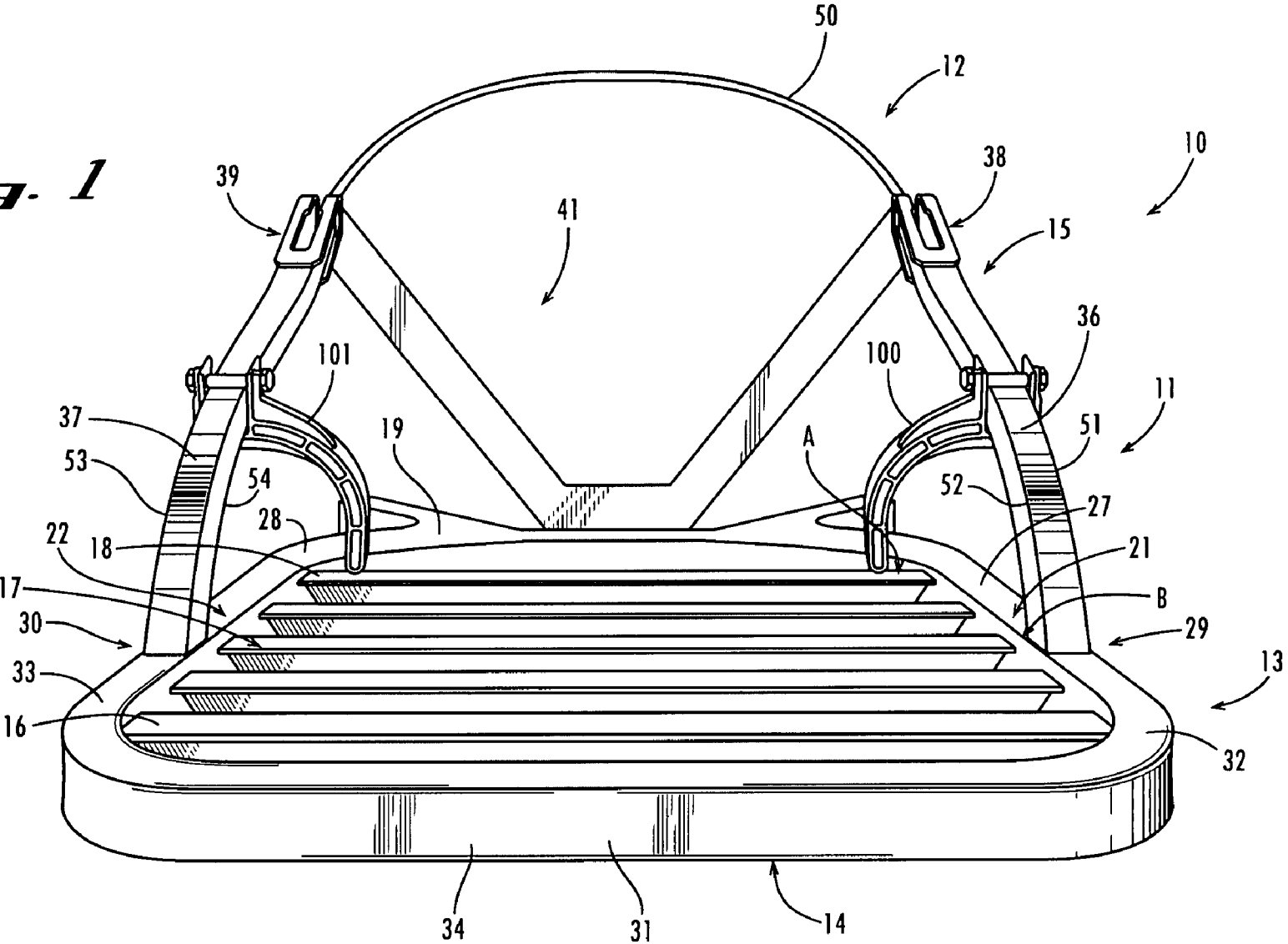
FIG. 1 is a perspective view of a foothold according to an illustrative form of the present invention shown attached to a climbing tree stand.

Referring now in detail to the drawing figures, wherein like reference numerals depict like parts throughout the several views, FIG. 1 illustrates one form of the present invention, in particular a climbing tree stand assembly 10. The climbing tree stand assembly 10 preferably includes a rigid climbing tree stand 15. In the illustrative embodiment depicted in the figures, the climbing tree stand 15 is shown as a cable-style tree stand. Those skilled in the art will recognize that the present invention is not limited to this particular style of climbing tree stand and that many different styles and designs of tree stands can be employed in or with the present invention. The climbing tree stand assembly 10 also includes a pair of rigid footholds or stirrups 100, 101. The footholds or stirrups 100, 101 are identical to one another, only their orientation on the climbing tree stand 10 differs. The immediately following section describes a cable-style climbing tree stand 15 that can be used in the present invention. After describing the stand, the description will continue with a description of the footholds or stirrups 100, 101.

The Stand

As shown in FIGS. 1-4, the climbing tree stand 15 includes a rigid platform structure indicated at 11 and a cable attachment indicated at 12. The rigid platform structure 11 includes a platform assembly indicated at 13. The platform assembly 13 includes a peripheral frame assembly 14 and a series of slats, such as slats 16-19. The peripheral frame assembly 14 also includes side frame members 27 and 28, as well as a generally U-shaped platform frame 31. The side frames 27 and 28 are welded to the U-shaped platform frame 31 in the vicinity of regions 29 and 30.

Figure 3:
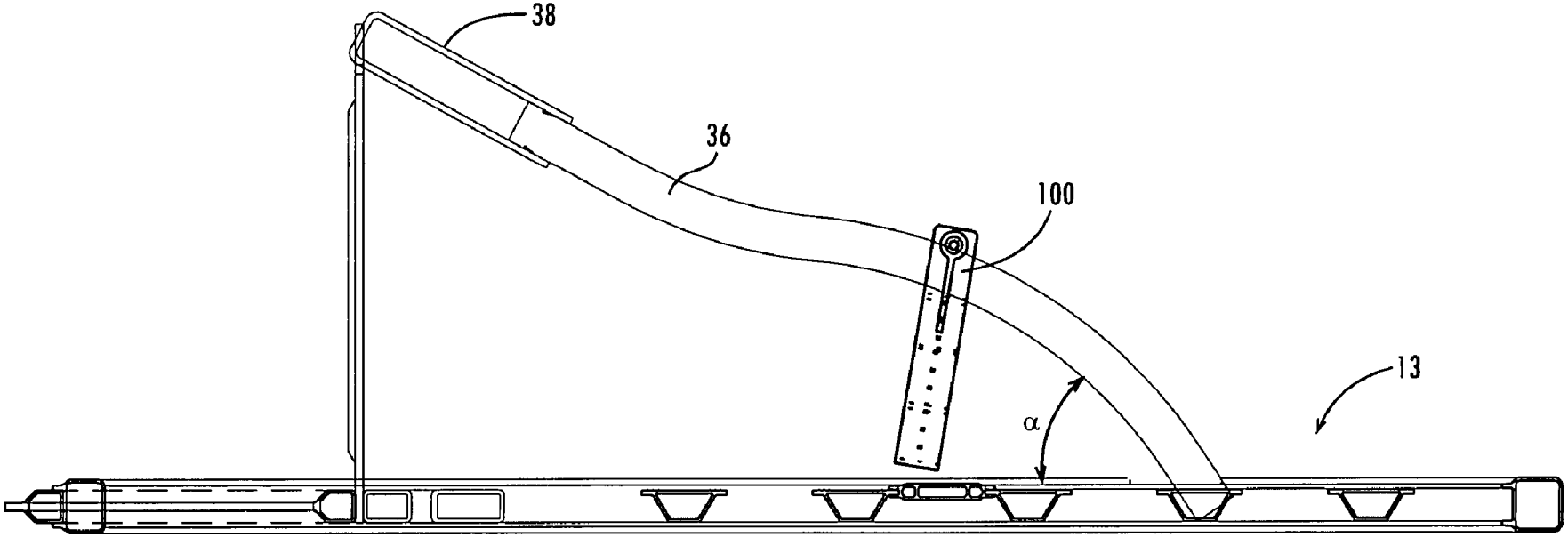
FIG. 3 is a side sectional view taken along the lines A-A of FIG. 2.
Figure 4:
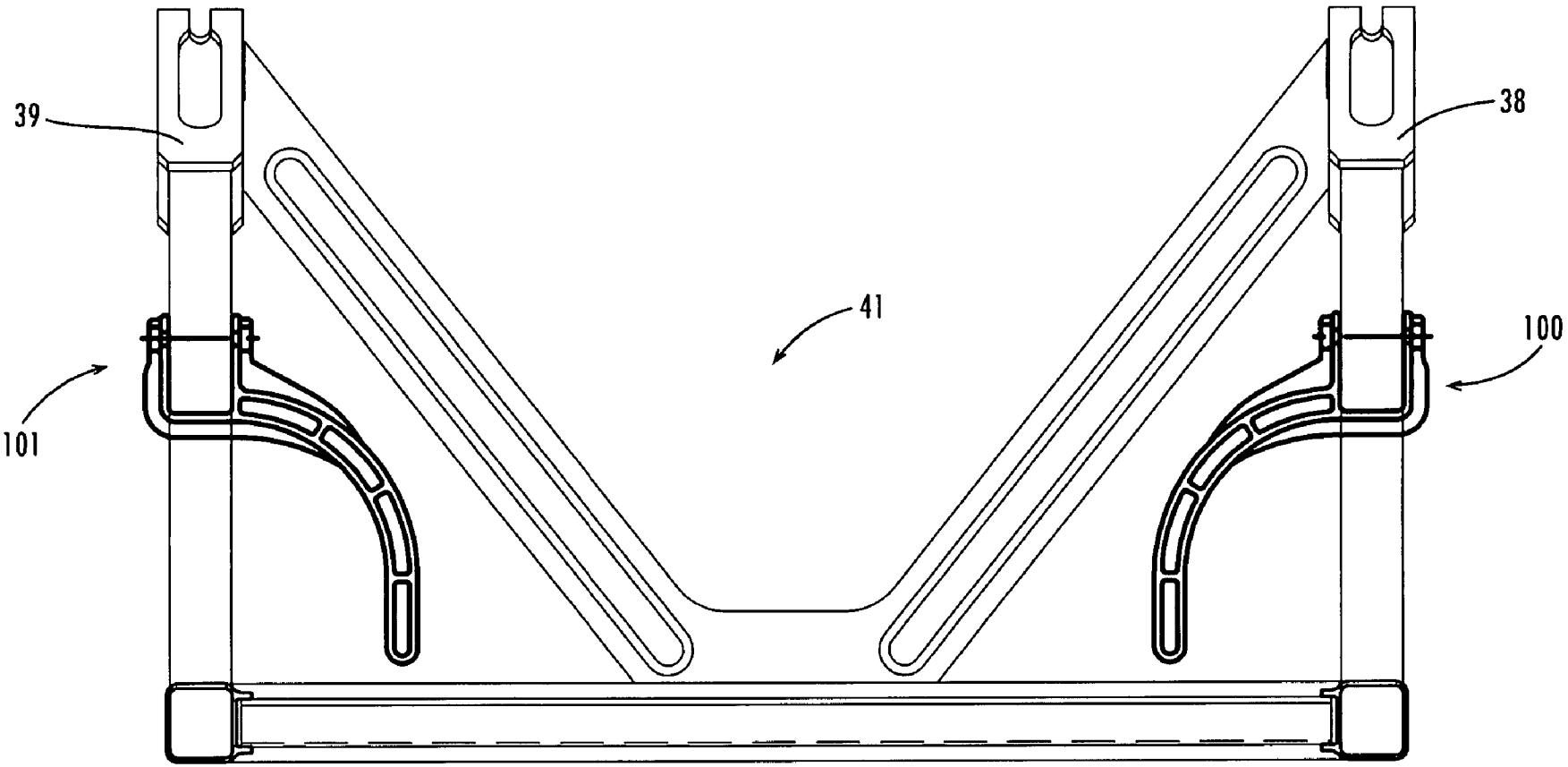
FIG. 4 is a front sectional view taken along the lines B-B of FIG. 2.
Figure 5C:
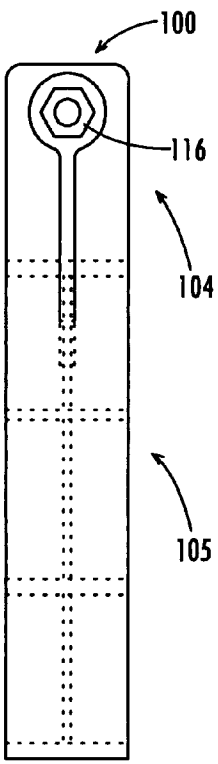
FIGS. 5A-5D are detailed views of the foothold of FIG. 1, shown apart from the climbing tree stand.
Figure 5D:
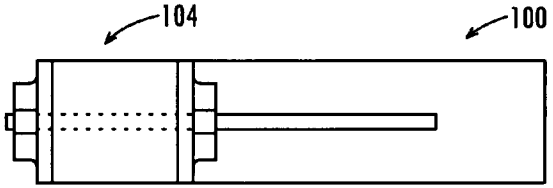
Figure 5A:
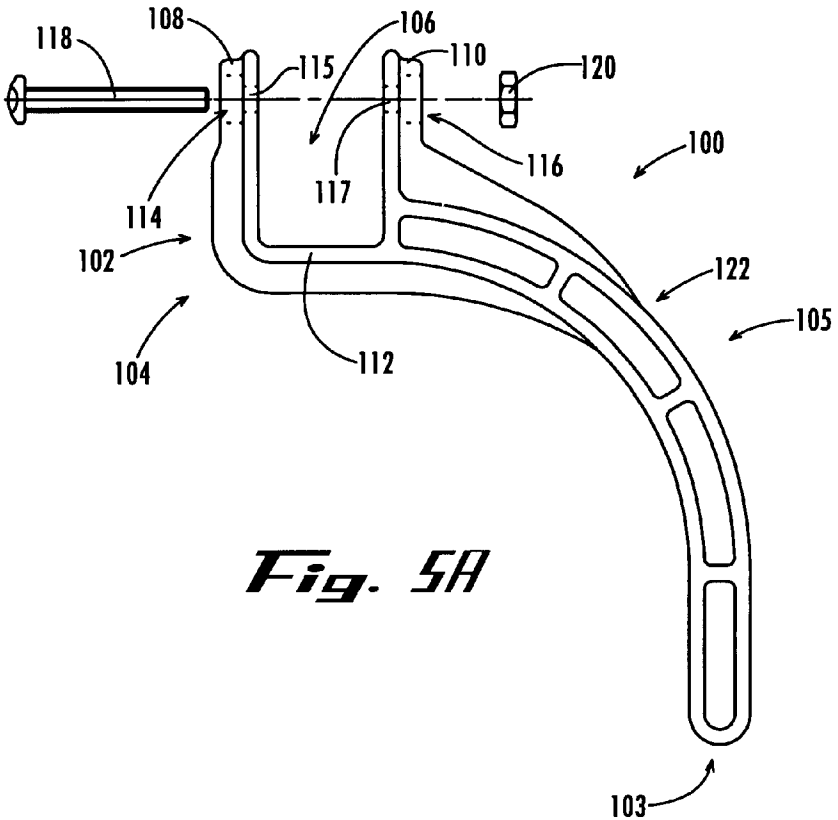
Figure 5B:
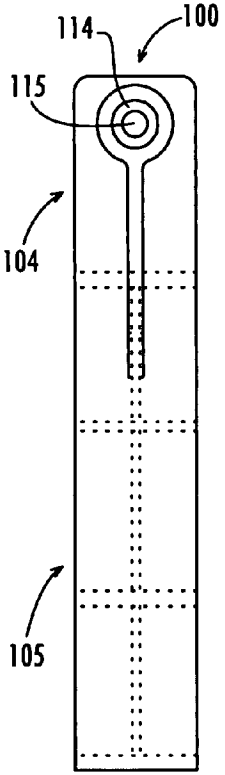

The U-shaped platform frame 31 includes three portions which lie in the plane of the platform assembly 13, namely portions 32, 33, and 34. Moreover, the U-shaped platform frame 31 also includes two upwardly angled portions or support arms, 36 and 37 for supporting the platform assembly adjacent a tree and for attachment to the cable attachment 12. Upwardly angled portions 36 and 37 have side surfaces 51, 52 and 53, 54, respectively. As best seen in FIGS. 3 and 1, the angled portions 36, 37 are oriented at an acute angle with respect to the remainder of the platform assembly 13. Preferably, the angle $\alpha$ is between about 10° and 40° and most preferably is about 26° or so and form crotches 21 and 22. While 26° has been found to work very well, other angles will work also. At the ends of the upwardly angled portions 36 and 37, cable retention cleats 38 and 39 are formed. The cable retention cleats 38, 39 can also be described as slotted clasps or sockets.

A U-shaped vertical frame 41 extends between the side frames 27 and 28 and the cable retention cleats 38 and 39 of the upwardly angled portions 36 and 37 of the U-shaped platform frame 31. A generally V-shaped yoke 42 is positioned beneath the U-shaped vertical frame 41, is welded thereto, and faces away from the platform assembly 13. The yoke 42 is adapted for at least partly straddling the tree and will be described in more detail below.

The frame components just described are made from 18 gauge steel tubing, 13/16 inches square. The individual pieces thereof are welded together and then powder coated (painted) to avoid corrosion.

Figure 2:
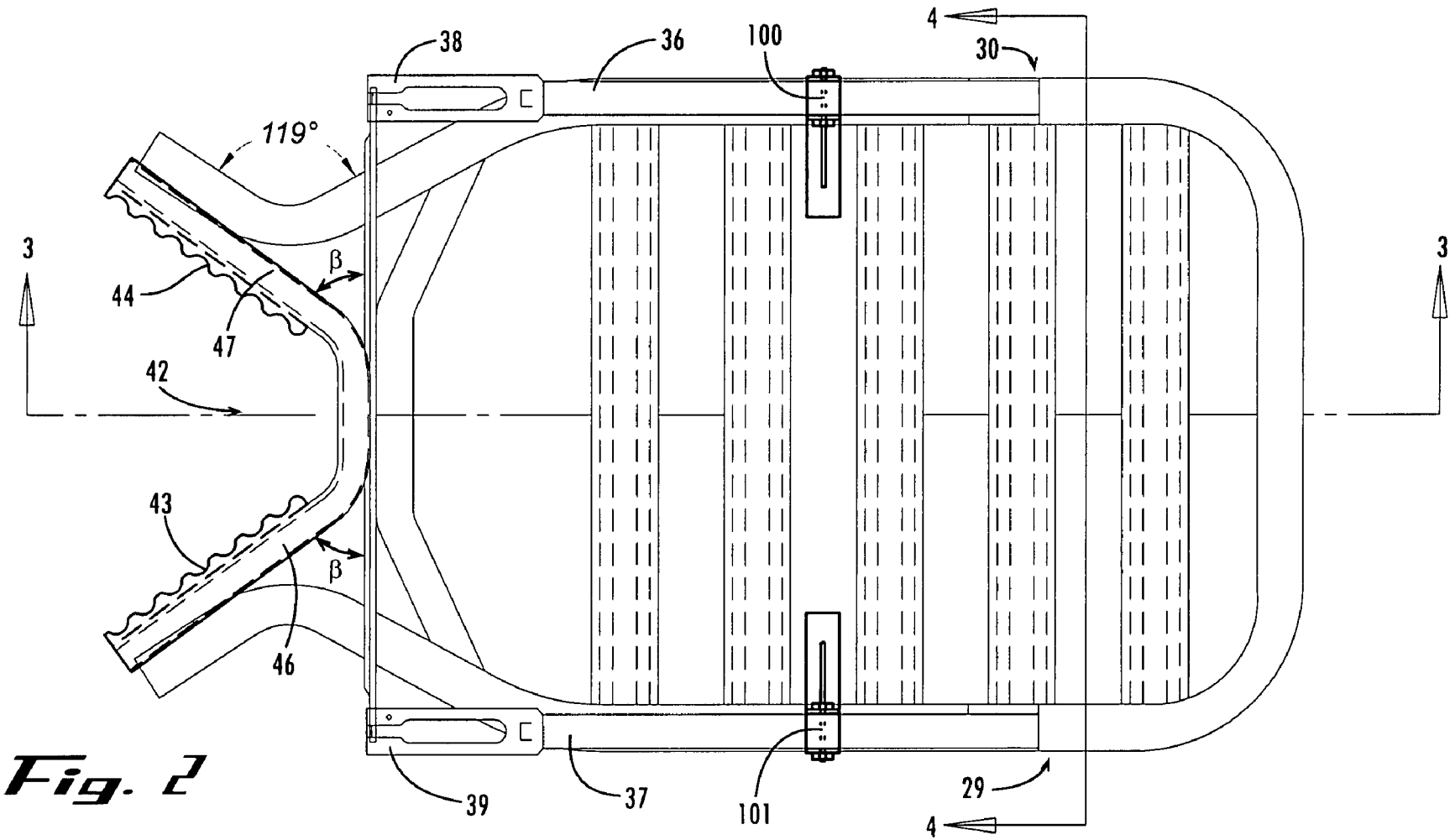
FIG. 2 is a plan view of the foothold of FIG. 1.

Referring again to the generally V-shaped yoke 42 of FIG. 2, the yoke includes tubular sections 46 and 47. Preferably, the inside faces 43 and 44 of the tubular sections 46, 47 are provided with a scalloped sill to help grip the tree and to avoid slippage in use.

Having now described the basic structure of the platform itself, attention is directed to the cable attachment 12. For clarity of illustration, FIG. 1 depicts one end of the cable retained by cleat 38 and the other end of the cable retained by cleat 39. The cable attachment 12 includes a cable 50 adapted to be looped about a tree and may further include a series of cylindrical nuts (collars) formed on the cable at the ends thereof. The nuts (or sleeves) can be in the form of cylindrical ferrules that have been swaged onto the cable 50. Of course, those skilled in the art will recognize that other shapes for the nuts can be employed as well. For example, the nuts could be spherical or box-shaped. The cylindrically-shaped nuts provide good strength at a reasonable cost.

Referring now again to FIG. 2, some other aspects of the platform and frame assembly will be considered. As shown in FIG. 2, the V-shaped yoke 42 includes first and second tubular sections 46 and 47, each of which is oriented at an angle $\beta$ of 56° with respect to the U-shaped vertical frame 41. As a result, the included angle between the tubular sections 46 and 47 is 68°. It has been found that this angle is particularly effective for engaging a tree and results in the yoke at least partly straddling the tree over a wide range of diameters, including trees having diameters between about 8" and slightly more than 20". Applicants have also found that an included angle of 72° works very well too.

The Stirrups/Footholds

As depicted in FIG. 1, the climbing tree stand assembly 10 also includes a pair of rigid footholds or stirrups 100, 101. FIGS. 5A-5D detail the structure of the foothold 100. It should be noted that the structure of the foothold 101 is identical to that of the foothold 100, only the mounted orientation on the climbing tree stand 10 differs.

The foothold 100 has a proximal end 102 and a distal end 103. Near the proximal end 102 is a head portion 104, and near the distal end 103 is a tail portion 105. Preferably, the head portion 104 and the tail portion 105 form a single continuous component. The head portion 104 and the tail portion 105 are constructed of a substantially rigid material. In one embodiment, the head portion 102 and the tail portion 104 comprise a molded plastic body. Of course, those skilled in the art will recognize that other materials for the footholds 100, 101 can be employed as well. For example, the footholds 100, 101 could be constructed of another durable material, such as a metal.

The head portion 104 includes a generally U-shaped clamping member 106 that can be mated with the upwardly angled portion 36. The U-shaped clamping member 106 has three portions, namely flanges 108, 110 and surface 112. Flange 108 has a bore 114 for receiving the bolt 118 and a fastener opening 115 therethrough. Flange 110 has a hexagonal nut retention socket 116 and a fastener opening 117 therethrough. The bolt 118 is secured to the head portion 104 with a locknut 120.

The tail portion 105 comprises a curved elongate body portion 122 that is curved generally downwardly toward the distal end 103. Preferably, with the foothold 100 attached to the angled portion 36, the tail portion 105 is configured to the engage a foot of the user of the tree stand 15. Those skilled in the art will recognize that the footholds 100, 101 can include other shapes that are configured to engage the feet of the user.

In one embodiment of the climbing tree stand assembly 10, the clamping members 106 of the footholds 100, 101 are secured to the angled portions 36, 37 at preselected locations. The preselected locations are determined by the size of the user's feet such that the distance between point A, located at the distal end 103 of the foothold 100, and point B, located at crotch 21, is wide enough to accommodate the user's right foot. It should be noted the footholds 100, 101 can be positioned at any location along the angled portions 36, 37. For example, if the user has a relatively small foot, then the distance between points A and B can be decreased by moving the head portion 104 of the foothold 100 along angled portion 36 towards the platform 11. If the user has a relatively large foot, then the distance between points A and B can be increased by moving the head portion 104 of the foothold 100 along angled portion 36 toward the cleat 38.

In one embodiment, the flanges 108, 110 of the foothold 100 engage the side surfaces 51, 52 of the angled portion 36. Once the foothold 100 is positioned at the preselected location, the bolt 118 is inserted through opening 115, over angled portion 36, and then through opening 117 of flange 110. The locknut 120 is threaded onto the bolt 118 in the retention socket 116, and when tightened, the locknut 120 secures the bolt 118, and consequently the foothold 100, to the climbing tree stand 15. In this embodiment, when the clamping member 106 is attached to the angled portion 36, the elongate body portion 122 of the foothold 100 extends generally toward and over the platform 11.

While the invention has been shown and described in preferred forms, it will be apparent to those skilled in the art that many modifications, additions, and deletions can be made therein. For example, the footholds can be secured to the platform of the tree stand assembly. These and other changes can be made without departing from the spirit and scope of the invention as set forth in the following claims.

We claim:

1. A climbing tree stand assembly comprising:

a platform;

a pair of support arms attached to the platform; and a pair of rigid footholds directly attached only to the support arms and extending generally over the platform, wherein the pair of footholds each comprise a curved elongate body portion and a clamping portion attached to the support arms.

2. The climbing tree stand assembly of claim 1, wherein the rigid footholds comprise substantially rigid molded plastic.

3. The climbing tree stand assembly of claim 1, wherein the clamping portion comprises a yoke for fastening to one of the support arms.

4. In a climbing tree stand including a platform and a pair of support arms attached to the platform, the climbing tree stand for use by a user, the improvement therein comprising:

a pair of rigid foothold devices directly attached only to the support arms and extending toward the platform wherein the pair of footholds each comprise a curved elongate body portion and a clamping portion attached to the support arms.

5. The improvement of claim 4, wherein the rigid foothold devices each comprise substantially rigid molded plastic.

6. The improvement of claim 4, wherein the clamping portion comprises a yoke for fastening to one of the support arms.

* * * * *